US011381916B2

(12) United States Patent
Hwang

(10) Patent No.: US 11,381,916 B2
(45) Date of Patent: Jul. 5, 2022

(54) SPEAKER SYSTEM OF PERSONAL MOBILITY DEVICE AND VEHICLE SPEAKER SYSTEM USING THE SAME

(71) Applicants: Hyundai Motor Company, Seoul (KR); Kia Motors Corporation, Seoul (KR)

(72) Inventor: Yonghwan Hwang, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 17/039,208

(22) Filed: Sep. 30, 2020

(65) Prior Publication Data

US 2021/0321195 A1 Oct. 14, 2021

(30) Foreign Application Priority Data

Apr. 14, 2020 (KR) ..... 10-2020-0045450

(51) Int. Cl.

| | |
|---|---|
| ***H04R 5/02*** | (2006.01) |
| ***H04R 1/40*** | (2006.01) |
| ***H04R 1/34*** | (2006.01) |
| ***H04R 3/12*** | (2006.01) |

(52) U.S. Cl.

CPC ..... *H04R 5/02* (2013.01); *H04R 1/345* (2013.01); *H04R 1/403* (2013.01); *H04R 3/12* (2013.01); *H04R 2499/13* (2013.01)

(58) Field of Classification Search

CPC ..... H04R 2499/13; H04R 1/025

USPC ..... 381/86, 302, 71.4, 334

See application file for complete search history.

(56) References Cited

U.S. PATENT DOCUMENTS

| | | | | |
|---|---|---|---|---|
| 9,065,403 | B2 * | 6/2015 | Takahashi | H03G 5/00 |
| 2007/0098198 | A1 * | 5/2007 | Hildebrandt | H04R 1/1075 381/370 |
| 2007/0291957 | A1 * | 12/2007 | Khan | H04B 1/082 381/86 |
| 2009/0067657 | A1 * | 3/2009 | Yasushi | H04R 5/023 381/333 |
| 2013/0182864 | A1 * | 7/2013 | Takahashi | G10K 15/02 381/61 |
| 2017/0142508 | A1 * | 5/2017 | Prommersberger | H04R 1/02 |
| 2020/0086939 | A1 * | 3/2020 | Iseman | B62K 3/002 |
| 2021/0029385 | A1 * | 1/2021 | Lee | H04N 21/2187 |

FOREIGN PATENT DOCUMENTS

KR 2018-0045672 A 5/2018

* cited by examiner

*Primary Examiner* — Disler Paul
(74) *Attorney, Agent, or Firm* — Fox Rothschild LLP

(57) ABSTRACT

A vehicle speaker system uses a speaker system of a personal mobility device including a main body configured to generate power with a battery, a steering unit connected to the main body to regulate a driving direction and in which a speaker is installed, wheels installed on the main body and the steering unit and rotated by power generated from the main body, and a controller configured to control the speaker, wherein the speaker generates a virtual engine sound when driving.

6 Claims, 7 Drawing Sheets

SPEAKER SYSTEM OF PERSONAL MOBILITY DEVICE AND VEHICLE SPEAKER SYSTEM USING THE SAME

CROSS-REFERENCE TO RELATED APPLICATION(S)

This application claims under 35 U.S.C. § 119 the benefit of Korean Patent Application No. 10-2020-0045450, filed on Apr. 14, 2020 in the Korean Intellectual Property Office, the entire contents of which are incorporated by reference herein.

BACKGROUND

1. Technical Field

The disclosure relates to a speaker system of a personal mobility device and a vehicle speaker system using the same, more particularly, to the speaker system of the personal mobility device in which when the personal mobility device is mounted in a vehicle, a speaker installed on the personal mobility device generates a virtual engine sound and assists a vehicle speaker, and a vehicle speaker system using the same.

2. Description of the Related Art

In general, a personal mobility device (PMD) travels at an average speed of around 25 Km/h using the power of a motor driven by a battery, and a high-end personal mobility device may travel at a high speed of 40 to 60 Km/h.

However, due to a low-noise motor, it is difficult for a pedestrian to early recognize that a personal mobility device traveling at a high speed approaches the pedestrian.

Therefore, in recent years, in addition to electric vehicles (EVs), a virtual engine sound system (VESS) that generates a virtual engine sound is required to be installed in a personal mobility device driven by a motor in order to prevent pedestrian accidents.

An electric vehicle utilizes an electric drive motor operated by electric energy stored in a battery to provide power to the vehicle, and uses a number of parts such as a battery and an electric drive motor, and thus the size, capacity, and position of a subwoofer occupying the largest volume in the vehicle may be narrowed, and speaker performance may be degraded.

SUMMARY

It is an aspect of the disclosure to provide a speaker system of a personal mobility device in which when the personal mobility device is mounted in a vehicle, a speaker installed on the personal mobility device generates a virtual engine sound and assists a vehicle speaker, and a vehicle speaker system using the same.

Additional aspects of the disclosure will be set forth in part in the description which follows and, in part, will be obvious from the description, or may be learned by practice of the disclosure.

In accordance with an aspect of the disclosure, a speaker system of a personal mobility device includes a main body configured to generate power with a battery, a steering unit connected to the main body to regulate a driving direction and in which a speaker is installed, wheels installed on the main body and the steering unit and rotated by power generated from the main body, and a controller configured to control the speaker, wherein the speaker generates a virtual engine sound when driving.

The steering unit may include a rod part coupled to the handle part, and an acoustic transmission portion to transmit acoustic energy generated from the speaker may be provided inside the rod part.

One or more frequency adjusters protruding toward an inner center of the rod part may be provided in the acoustic transmission portion.

The one or more frequency adjusters may include a first frequency adjuster, a second frequency adjuster, and a third frequency adjuster, which are formed along an inner circumferential surface of the rod part, and a length between the first frequency adjuster and the second frequency adjuster and a length between the second frequency adjuster and the third frequency adjuster may be different from each other.

The speaker may be installed at one end of the rod part, and the steering unit may include an accommodating part to accommodate the rod part and the speaker.

In accordance with another aspect of the disclosure, a vehicle speaker system uses a speaker system of a personal mobility device, wherein the speaker system of the personal mobility device is controlled by a vehicle controller installed in a vehicle when mounted in the vehicle.

A main body, a steering unit, wheels, and a controller may be mounted in an accommodating part provided in the vehicle, and the accommodating part may be provided in the form of an encloser to utilize acoustic energy transmitted through a speaker as a low-pitched frequency.

The battery and the speaker may be electrically connected to the vehicle through a connection part provided in the vehicle, and the vehicle controller installed in the vehicle may control the speaker through the connection part.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
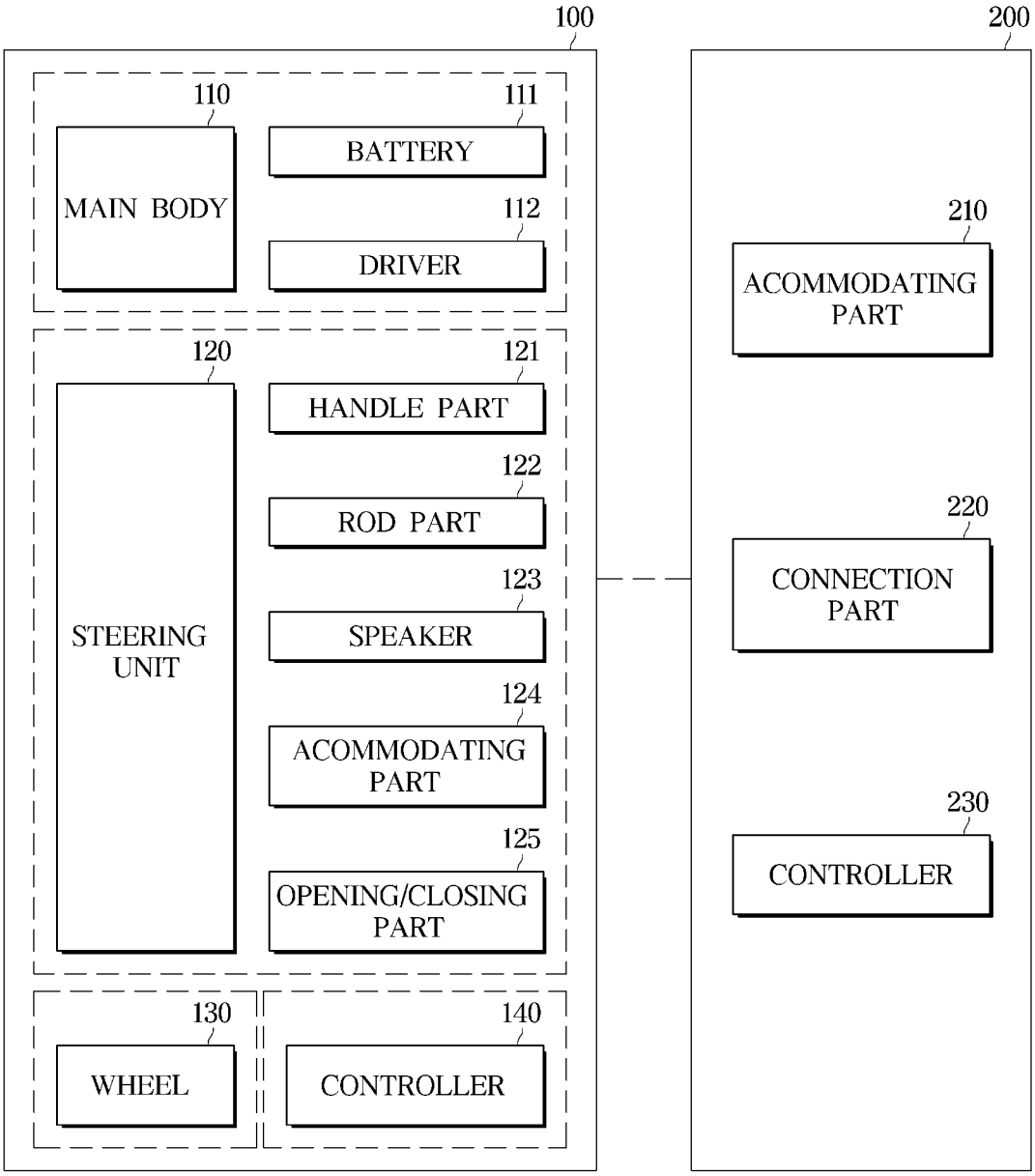
FIG. 1 is a schematic diagram illustrating a speaker system of a personal mobility device according to an embodiment of the disclosure and a vehicle speaker system using the same.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Hereinafter embodiments of the disclosure will be described in detail with reference to the accompanying drawings. The embodiments described below are provided by way of example so that those skilled in the art will be able to fully understand the spirit of the disclosure. The disclosure is not limited to the embodiments described below, but may be embodied in other forms. In order to clearly explain the disclosure, parts not related to the description are omitted from the drawings, and the width, length, thickness, etc. of the components may be exaggerated for convenience.

Hereinafter, a speaker system of a personal mobility device and a vehicle speaker system using the same according to an embodiment of the disclosure will be described with reference to FIGS. 1 to 7.

Figure 2:
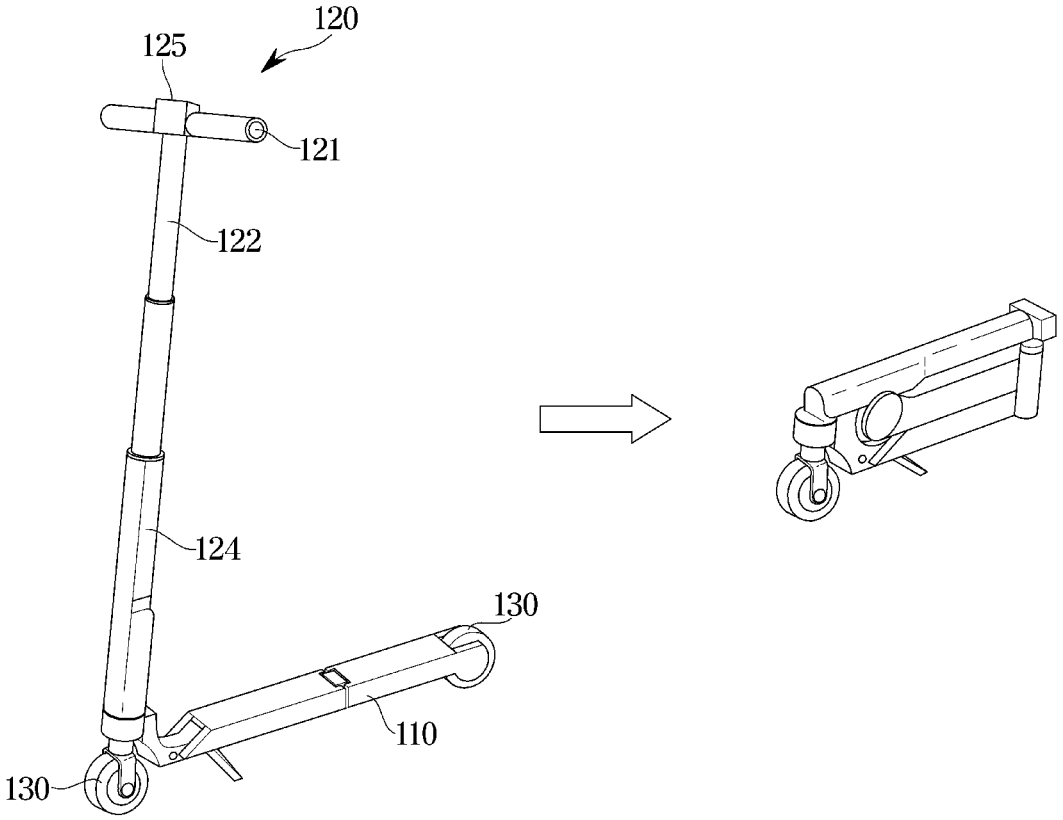
FIG. 2 illustrates the speaker system of the personal mobility device according to an embodiment of the disclosure.

FIG. 1 is a schematic diagram illustrating a speaker system of a personal mobility device according to an embodiment of the disclosure and a vehicle speaker system using the same, and FIG. 2 illustrates the speaker system of the personal mobility device according to an embodiment of the disclosure.

Figure 3:
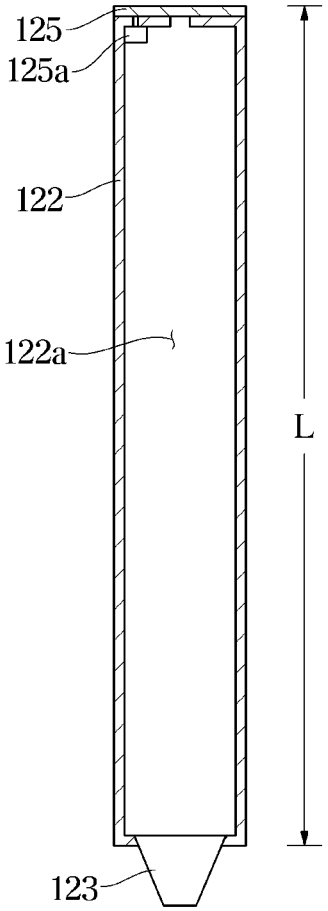
FIG. 3 illustrates a rod part of the speaker system of the personal mobility device according to an embodiment of the disclosure.
Figure 4:
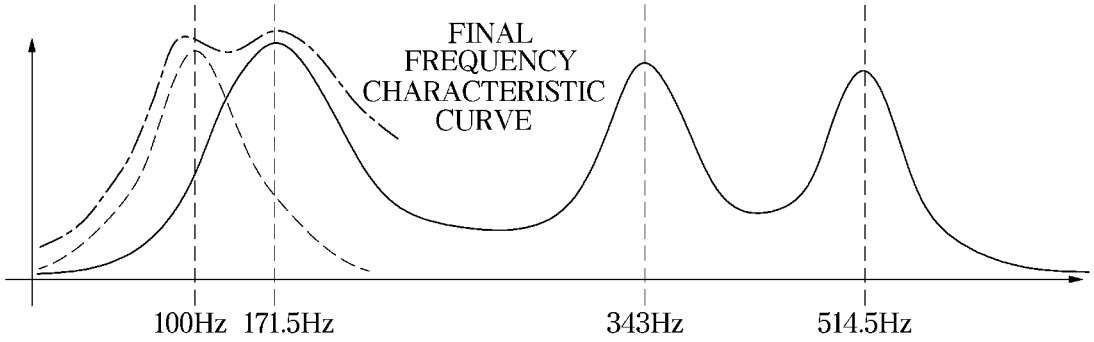
FIG. 4 illustrates sound wave forms by the rod part illustrated in FIG. 3.

FIG. 3 illustrates a rod part of the speaker system of the personal mobility device according to an embodiment of the disclosure, and FIG. 4 illustrates sound wave forms by the rod part illustrated in FIG. 3.

Figure 5:
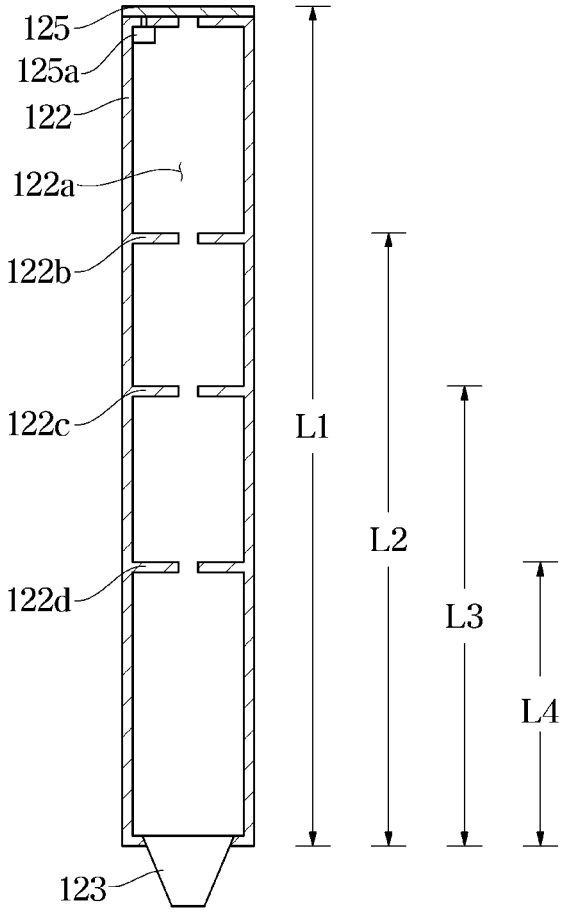
FIG. 5 illustrates a rod part of another form according to an embodiment of the disclosure.
Figure 6:
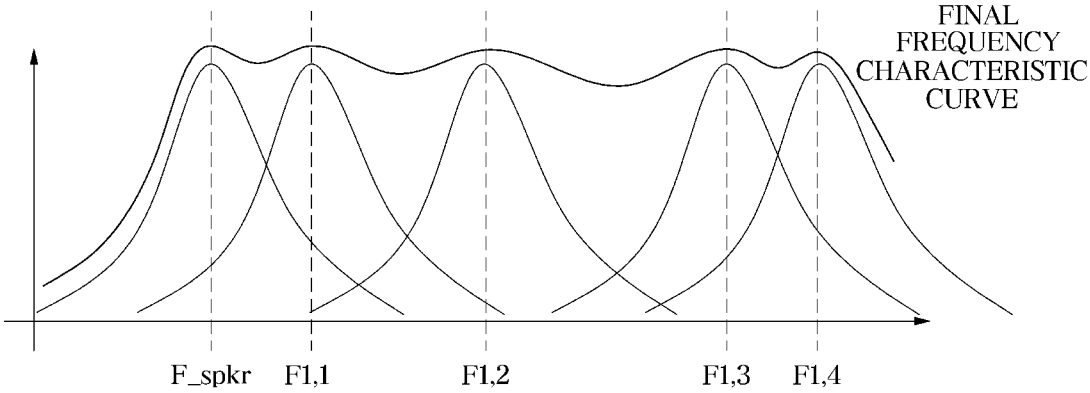
FIG. 6 illustrates sound wave forms by the rod part illustrated in FIG. 5.

FIG. 5 illustrates a rod part of another form according to an embodiment of the disclosure, and FIG. 6 illustrates sound wave forms by the rod part illustrated in FIG. 5.

Figure 7:
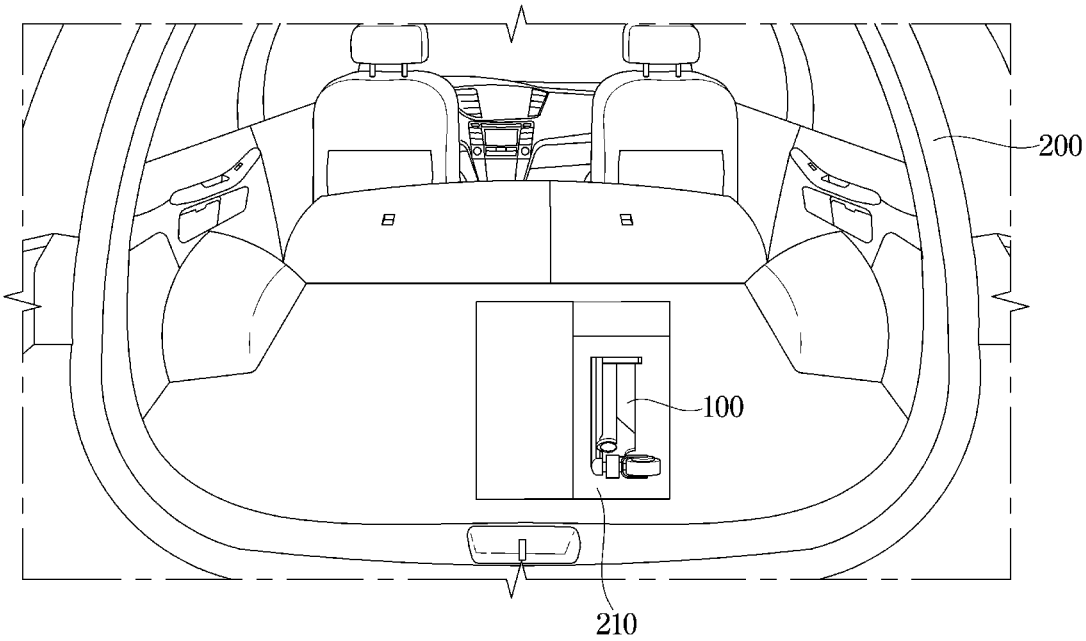
FIG. 7 illustrates that the speaker system of the personal mobility device according to an embodiment of the disclosure is mounted on a vehicle.

FIG. 7 illustrates that the speaker system of the personal mobility device according to an embodiment of the disclosure is mounted on a vehicle.

As illustrated in FIGS. 1 to 7, a speaker system 100 of a personal mobility device according to an embodiment of the disclosure includes a main body 110, a steering unit 120, wheels 130, and a controller 140.

The main body 110 is used as a footrest on which a user rides and generates power by a battery 111. The main body 110 drives a driver 112, which is a motor, using electric power generated by the battery 111.

The main body 110 may have a predetermined strength to support a weight of the user and may be provided in the form of a case in which a space is formed to accommodate the battery 111, the controller 140, and the like.

The steering unit 120 is connected to the main body 110 to regulate a driving direction. The steering unit 120 includes a handle part 121, a rod part 122, a speaker 123, an accommodating part 124, and an opening/closing part 125.

The handle part 121 is provided on an upper side of the steering unit 120 so that the steering unit 120 may be controlled by the user, and may have a structure that is folded when mounted on the vehicle 200 by being connected to the rod part 122 through a hinge structure.

The rod part 122 is connected to the handle part 121 and is elongated or contracted by a predetermined length to assist the driving of the user holding the handle part 121. The rod part 122 is provided with an acoustic transmission portion 122*a* therein to transmit acoustic energy generated from the speaker 123. The rod part 122 may be provided in a telescopic form in which a plurality of tubes is overlapped to reduce a length of the accommodating part 124.

The speaker 123 is installed at a lower end of the rod part 122 to supply acoustic energy to the acoustic transmission portion 122*a* and is controlled by the controller 140. The speaker 123 generates a virtual engine sound when driving, and output of the virtual engine sound may be controlled by the controller 140.

The speaker 123 may be controlled by the controller 140 installed in the personal mobility device when not mounted in the vehicle 200, and may be controlled by a vehicle controller 230 installed in the vehicle 200 when mounted in the vehicle 200.

The accommodating part 124 is connected to the rod part 122 at one end thereof to prevent the elongated or contracted rod part 122 from being separated, and is provided in a hollow form so that the rod part 122 and the speaker 123 are accommodated in the accommodating part 124.

The opening/closing part 125 is provided at the opposite side of the lower end of the rod part 122 where the speaker 123 is installed, that is, at an upper end, and transfers acoustic energy supplied to the acoustic transmission portion 122*a* to the outside of the acoustic transmission portion 122*a*. The opening/closing part 125 may be provided at one end of the rod part 122 in a slide structure, a hinge structure, or a dial structure, and is provided with a motor 125*a* so that opening and closing may be controlled by the controller 140. The opening/closing part 125 may be controlled by the vehicle controller 230 installed in the vehicle 200 when mounted in the vehicle 200.

The wheels 130 are installed on the main body 110 and the steering unit 120 and rotated by the power generated by the main body 110. The wheels 130 may be installed one by one on the main body 110 and the steering unit 120 in order to reduce a weight of the personal mobility device.

The controller 140 controls the speaker 123 and may generate a virtual engine sound through the speaker 123 when the user moves using the personal mobility device. The virtual engine sound may be composed of a driving sound of a power device such as an engine driving sound and a motor driving sound and prevents collisions with pedestrians by recognizing the approach of the personal mobility device to the pedestrians. The controller 140 may independently control the speaker 123 and may control the speaker 123 in connection with the vehicle controller 230 provided in the vehicle 200 when mounted on the vehicle 200.

Hereinafter, the acoustic transmission portion 122*a* provided in the rod part 122 will be described in detail. The acoustic transmission portion 122*a* is provided in the form of an empty space in the rod part 122, and specifically, may be formed in the form of a hollow tube in the rod part 122. The frequency characteristics of the acoustic transmission portion 122*a* may be changed according to a length L of the rod part 122 as shown in Equation 1 below, and it is preferable that the length L of the rod part 122 is 1 m or more in consideration of the user's body and low-pitched frequency characteristics.

$$L = \frac{\lambda}{2}n,\ n = 1, 2, 3, \ldots \qquad \text{[Equation 1]}$$

L: length of rod part

λ: Wavelength of frequency n: The number of repetitions of wavelength

A resonant frequency of the acoustic transmission portion 122*a* may be expressed as Equation 2. The resonant frequency of the acoustic transmission portion 122*a* may appear as 171.5 Hz, 343 Hz, and 514.5 Hz when the length of the rod part 122 is 1 m, and when a resonant frequency of the speaker 123 is set to 100 Hz, the final frequency characteristic curve appears as shown in FIG. 4, indicating that a low frequency characteristic is satisfied. In FIG. 4, a horizontal axis represents frequency (unit: Hz), and a vertical axis represents sound pressure (unit: dB).

$$f_n = \frac{c}{2L}n,\ n = 1, 2, 3, \ldots \qquad \text{[Equation 2]}$$

fn: Resonant frequency c: Constant

L: length of rod part n: The number of repetitions of wavelength

That is, a vehicle speaker system using the personal mobility device according to an embodiment of the disclosure may satisfy a low frequency characteristic required by a subwoofer of the vehicle 200 when the length of the rod part 122 is 1 m or more and the resonant frequency of the speaker 123 is 100 Hz.

One or more frequency adjusters 122*b*, 122*c*, and 122*d* protruding toward an inner center of the rod part 122 may be provided in the acoustic transmission portion 122*a*. The frequency adjusters 122*b*, 122*c*, and 122*d* may be provided in the form of a partition wall protruding toward the inner center of the rod part 122, and may include the first frequency adjuster 122*b*, the second frequency adjuster 122*c*, and the third frequency adjuster 122*d*.

The first frequency adjuster 122*b*, the second frequency adjuster 122*c*, and the third frequency adjuster 122*d* are formed along an inner circumferential surface of the rod part 122, and a length between the first frequency adjuster 122*b* and the second frequency adjuster 122*c* and a length between the second frequency adjuster 122*c* and the third frequency adjuster 122*d* may be different from each other.

The resonant frequency of the acoustic transmission portion 122*a* may be adjusted by the frequency adjusters 122*b*, 122*c*, and 122*d*, and the resonant frequency of the acoustic transmission portion 122*a* adjusted by the frequency adjusters 122*b*, 122*c*, and 122*d* may be expressed as Equation 3.

$$f_{n,m} = \frac{c}{2L_m}n,\ n = 1, 2, 3, \ldots\ ,\ m = 1, 2, 3, \ldots \qquad \text{[Equation 3]}$$

fn,m: Resonant frequency c: Constant

Lm: Length of rod part or length of frequency adjuster n: The number of repetitions of wavelength In Equation 3, Lm refers to the length of the rod part 122 or lengths of frequency adjusters 122*b*, 122*c*, and 122*d*, and specifically, L1 refers to the length of the rod part 122, L2 refers to a length between the speaker 123 and the first frequency adjuster 122*b*, L3 refers to a length between the speaker 123 and the second frequency adjuster 122*c*, and L4 refers to a length between the speaker 123 and the third frequency adjuster 122*d*.

The final frequency characteristic curve appears as shown in FIG. 6, so that it may be seen that the resonant frequency controlled by the frequency adjusters 122*b*, 122*c*, and 122*d* may secure an appropriate output for an audible sound wave.

That is, the resonant frequency of the acoustic transmission portion 122*a* may be adjusted by the frequency adjusters 122*b*, 122*c*, and 122*d*, and the final frequency characteristic curve may be adjusted by adjusting intervals between the frequency adjusters 122*b*, 122*c*, and 122*d*.

In FIG. 6, the horizontal axis represents frequency (unit: Hz), the vertical axis represents sound pressure (unit: dB), F_spkr refers to a resonant frequency of the speaker, F1,1 refers to a resonant frequency by L1, F1,2 refers to a resonant frequency by L2, F1,3 refers to a resonant frequency by L3, and F1,4 refers to a resonant frequency by L4.

The vehicle speaker system according to an embodiment of the disclosure may be provided by mounting the speaker system 100 of the personal mobility device on the vehicle 200.

The speaker system 100 of the personal mobility device is mounted in the vehicle 200 to assist the speaker of the vehicle 200, and the vehicle 200 is provided with an accommodating part 210, a connection part 220 and the vehicle controller 230.

The accommodating part 210 is provided in one space such as spaces in a trunk, a door and a side panel of the vehicle 200, and the main body 110, the steering unit 120, the wheels 130 and the controller 140 are mounted therein. The accommodating part 210 may be provided in the form of an encloser to utilize acoustic energy transmitted through the speaker 123 as a low frequency. The encloser, which is a volume frame that maintains an outer skeletal frame of the speaker system, refers to a cabinet in which each of the speaker units is mounted and accommodated in the speaker system.

The accommodating part 210 may be provided in a form connected to a separate enclosure in order to utilize the speaker system 100 of the personal mobility device as a subwoofer by improving the low-pitched characteristic of a vehicle speaker system using the speaker system 100 of the personal mobility device.

The connection part 220 electrically connects the battery 111 and the speaker 123 to the vehicle 200 and transmits power and control signals to the battery 111 and the speaker 123. The connection part 220 may transmit a control signal to the speaker 123 using a wireless communication module, and for example, may transmit a control signal to the speaker 123 using a Bluetooth module.

The vehicle controller 230 controls the speaker 123 through the connection part 220, and may directly control the speaker 123 installed in the speaker system 100 of the personal mobility device according to a speaker output of the vehicle 200, or may indirectly control the speaker 123 through the controller 140 installed in the speaker system 100 of the personal mobility device.

The vehicle controller 230 may open the opening/closing part 125 by controlling the motor 125*a* installed in the opening/closing part 125 and may transmit acoustic energy supplied to the acoustic transmission portion 122*a* to the accommodating part 210 by opening the opening/closing part 125.

As is apparent from the above, a speaker system of a personal mobility device according to an embodiment of the disclosure generates a virtual engine sound through a speaker when driving, so that pedestrians can be informed of the approach of the personal mobility device and pedestrian accidents can be prevented in advance.

A vehicle speaker system using the speaker system of the personal mobility device according to an embodiment of the disclosure assists a speaker of a vehicle by using the personal mobility device, so that the vehicle speaker system can be implemented using a small space.

In addition, because the speaker system of the personal mobility device is used to assist the speaker of a vehicle, a broadband characteristic of a speaker can be secured with only one of the speaker.

Although the present disclosure has been described above with reference to exemplary embodiments of the present disclosure, those skilled in the art will understand that the present disclosure may be variously modified and changed without departing from the spirit and scope of the present disclosure set forth in the appended claims.

What is claimed is:

1. A speaker system of a personal mobility device, the speaker system comprising:

a main body configured to generate power with a battery;

a steering unit connected to the main body to regulate a driving direction and in which a speaker is installed;

wheels installed on the main body and the steering unit and rotated by power generated from the main body; and a controller configured to control the speaker, wherein the speaker generates a virtual engine sound when driving, and wherein the steering unit comprises a rod part coupled to a handle part, an acoustic transmission portion formed in the form of a hollow tube in the rod part to transmit acoustic energy generated from the speaker and one or more frequency adjusters protruding toward an inner center of the rod part provided in the acoustic transmission portion.

2. The speaker system according to claim 1, wherein:

the one or more frequency adjusters comprise a first frequency adjuster, a second frequency adjuster, and a third frequency adjuster, which are formed along an inner circumferential surface of the rod part, and a length between the first frequency adjuster and the second frequency adjuster and a length between the second frequency adjuster and the third frequency adjuster are different from each other.

3. The speaker system according to claim 1, wherein the speaker is installed at one end of the rod part, and the steering unit comprises an accommodating part to accommodate the rod part and the speaker.

4. A vehicle speaker system using the speaker system according to claim 1, wherein the speaker system of the personal mobility device is controlled by a vehicle controller installed in a vehicle when mounted in the vehicle.

5. The vehicle speaker system according to claim 4, wherein the main body, the steering unit, the wheels, and the controller are mounted in an accommodating part provided in the vehicle, and the accommodating part is provided in the form of an encloser to utilize acoustic energy transmitted through a speaker as a low-pitched frequency.

6. The vehicle speaker system according to claim 4, wherein the battery and the speaker are electrically connected to the vehicle through a connection part provided in the vehicle, and the vehicle controller installed in the vehicle controls the speaker through the connection part.

* * * * *